US009958832B2

(12) United States Patent
Winkler et al.

(10) Patent No.: US 9,958,832 B2
(45) Date of Patent: May 1, 2018

(54) METHOD FOR SYNCHRONIZATION OF TWO TIMEPIECE OSCILLATORS WITH ONE GEAR TRAIN

(71) Applicant: ETA SA Manufacture Horlogere Suisse, Grenchen (CH)

(72) Inventors: Pascal Winkler, St-Blaise (CH); Davide Sarchi, Renens (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days. days.

(21) Appl. No.: 15/308,508

(22) PCT Filed: Jun. 22, 2015

(86) PCT No.: PCT/EP2015/063892
§ 371 (c)(1),
(2) Date: Nov. 2, 2016

(87) PCT Pub. No.: WO2016/037717
PCT Pub. Date: Mar. 17, 2016

(65) Prior Publication Data

US 2017/0068216 A1 Mar. 9, 2017

(30) Foreign Application Priority Data

Sep. 9, 2014 (EP) ..... 14184155

(51) Int. Cl.
*G04B 17/06* (2006.01)
*G04B 17/26* (2006.01)

(52) U.S. Cl.
CPC ..... *G04B 17/063* (2013.01); *G04B 17/26* (2013.01)

(58) Field of Classification Search
CPC .... G04B 17/06; G04B 17/063; G04B 17/066; G04B 17/26; G04B 17/28
See application file for complete search history.

(56) References Cited

U.S. PATENT DOCUMENTS 1,232,285 A * 7/1917 Greeley ..... G04B 15/00 368/132
7,950,846 B2 * 5/2011 Hessler ..... G04B 17/20 368/127

(Continued)

FOREIGN PATENT DOCUMENTS

EP 2 141 555 B1 * 1/2010
EP 2 365 403 A2 * 9/2011

(Continued)

OTHER PUBLICATIONS

International Search Report dated Apr. 5, 2016 in PCT/EP2015/063892 filed Jun. 22, 2015.*

*Primary Examiner* — Sean Kayes

(74) *Attorney, Agent, or Firm* — Oblon, McClelland, Maier & Neustadt, L.L.P.

(57) ABSTRACT

A timepiece regulating mechanism including, mounted to be movable, at least in a pivoting motion, with respect to a plate, an escape wheel configured to receive a drive torque via a gear train, a first oscillator including a first rigid structure, connected to the plate by a first flexible strip and a second flexible strip, crossed with each other, a second oscillator including a second rigid structure connected to the first rigid structure by a third flexible strip and a fourth flexible strip crossed with each other, and the second structure including a guide configured to cooperate with a complementary guide included in the escape wheel, synchronizing the first oscillator and the second oscillator with the gear train.

27 Claims, 4 Drawing Sheets

(56) References Cited

U.S. PATENT DOCUMENTS

| | | | | |
|---|---|---|---|---|
| 8,002,460 | B2 * | 8/2011 | Daout | G04B 17/20 368/175 |
| 8,770,828 | B2 * | 7/2014 | Ching | G04B 17/066 368/169 |
| 9,465,363 | B2 * | 10/2016 | Winkler | G04B 17/04 |
| 2010/0002548 | A1 * | 1/2010 | Hessler | G04B 17/06 368/129 |
| 2011/0222377 | A1 * | 9/2011 | Ching et al. | |
| 2015/0131413 | A1 * | 5/2015 | Helfer | G04C 3/042 368/77 |
| 2016/0231708 | A1 * | 8/2016 | Roth | G04B 13/008 |

FOREIGN PATENT DOCUMENTS

| | | | |
|---|---|---|---|
| EP | 2 431 823 | A1 * | 3/2012 |
| EP | 2 908 189 | A2 * | 8/2015 |

* cited by examiner

METHOD FOR SYNCHRONIZATION OF TWO TIMEPIECE OSCILLATORS WITH ONE GEAR TRAIN

FIELD OF THE INVENTION

The invention concerns a timepiece regulating mechanism comprising a plate and, mounted to move at least in a pivoting motion with respect to said plate, an escape wheel that pivots about an axis of escapement and is arranged to receive a drive torque, via a gear train, and a first oscillator comprising a first rigid structure connected to said plate by first elastic return means, The invention concerns a timepiece movement including such a regulating mechanism.

The invention concerns a timepiece including such a movement.

The invention concerns the field of the regulation of mechanical timepieces, in particular mechanical watches.

BACKGROUND OF THE INVENTION

In a timepiece escapement mechanism, the efficiency of the Swiss lever escapement that is generally used is relatively low (on the order of 35%).

The main sources of losses in a Swiss lever escapement are:

the friction of the pallet-stones on the teeth;

shocks due to the jerky movements of the wheel and the pallet lever;

the drop necessary to accommodate machining errors.

The development of a new system for synchronizing a gear train driven by a mainspring with a resonator inside a watch movement, with greater efficiency than that of a Swiss lever escapement, may result in:

an increase in the autonomy of the watch;

an improvement in the chronometric properties of the watch; marketing and aesthetic differentiation.

Systems are sought that can synchronize a gear train driven by a mainspring with a resonator, and which offer greater efficiency than the efficiency of the Swiss lever escapement.

SUMMARY OF THE INVENTION

The invention proposes to create mechanisms that offer greater efficiency than the efficiency of the Swiss lever escapement.

The invention consists of a system for synchronizing a gear train, in particular driven by a mainspring, with a resonator.

To this end, the invention concerns a timepiece regulating mechanism according to claim 1.

The invention concerns a timepiece movement including such a regulating mechanism.

The invention concerns a timepiece including such a movement, characterized in that the timepiece is a watch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
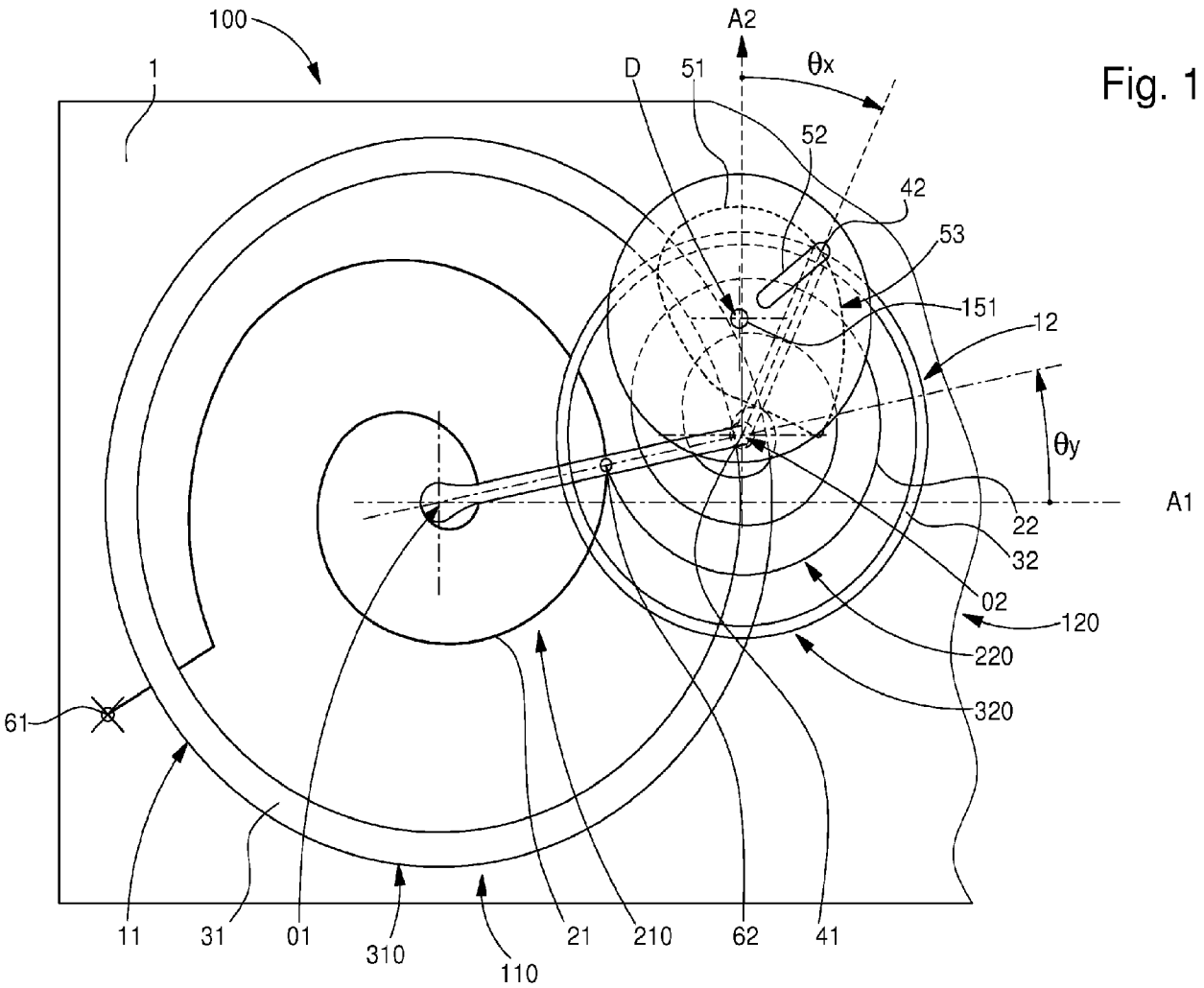
FIG. 1 shows a schematic plan view of a first variant of a regulating mechanism according to the invention, comprising two oscillators formed of sprung balance assemblies, one of which pivots on the other and cooperates with an escape wheel, in an instantaneous state during an oscillation of each of these sprung balance assemblies.

The invention consists of a system for synchronizing a gear train driven by a mainspring with a resonator.

The invention more particularly concerns the regulation of mechanical movements.

The principle of the invention is to fit a mechanical watch with a movement comprising at least two series connected oscillators, in particular placed one atop the other, synchronized with a gear train via mechanical cooperation between the last oscillator of the cascade and a component of the gear train, between guide means and complementary guide means, notably a finger and a cam, or more particularly a finger and a grooved wheel. The invention is illustrated in a non-limiting manner, with only two cascade connected oscillators.

More particularly, the invention concerns a timepiece regulating mechanism 100. This regulating mechanism 100 comprising a main plate 1 and, mounted to move at least in a pivoting motion relative to plate 1, an escape wheel 51 and a first resonator 110.

Escape wheel 51 pivots about an axis of escapement D and is arranged to receive a drive torque, via a gear train. In a particular application, this drive torque is provided by an energy storage means, such as a barrel, of a movement 200 in which regulating mechanism 100 is intended to be incorporated.

First resonator 110 comprises a first rigid structure 310, which is connected to plate 1 by first elastic return means 210.

According to the invention, regulating mechanism 100 also includes at least a second oscillator 120. This second oscillator 120 comprises a second rigid structure 320, which is connected to first rigid structure 310 of first oscillator 110 by second elastic return means 220.

These second elastic return means 220 are arranged to allow at least a pivoting motion of second rigid structure 320 with respect to first rigid structure 310.

This second structure 320 includes guide means 42, which are arranged to cooperate with complementary guide means 52 comprised in escape wheel 51. These guide means 42 and complementary guide means 52 together form a means for transmitting motion, to synchronize first oscillator 110 and second oscillator 120 with the gear train to which escape wheel 51 belongs.

This motion transmission means may take different forms: a pin-groove system, as illustrated in a non-limiting manner by the Figures, a crank-connecting rod or other system.

The invention is described here with two series connected oscillators. Naturally, it is also applicable to a cascade of series connected oscillators.

Preferably, first oscillator 110 and second oscillator 120 have equal natural frequencies.

Preferably, first oscillator 110 and second oscillator 120 have a substantially constant angular phase shift between them, close to 90°.

These at least two resonators, formed by first oscillator 110 and second oscillator 120, preferably having the same natural frequency, each having one degree of angular freedom, are placed one atop the other such that a particular point of the second resonator travels a closed, potato-shaped trajectory 53 about a fixed point, which here is pivot 151 of escape wheel 51, for the mechanisms illustrated in the Figures. The closer the shape of trajectory 53 is to a circle, the better the synchronization will be. Trajectory 53 is more generally an ellipse, whose eccentricity depends on the geometry of the mechanism, particularly at the connection between guide means 42 and complementary guide means 52.

In an advantageous embodiment, first oscillator 110 pivots about a first pivot axis O1, and oscillates in a plane parallel to plate 1 on either side of a first plane axis A1, second oscillator 120 pivots about a second pivot axis O2 and oscillates in a plane parallel to plate 1 about a second plane axis A2, and, in projection onto plate 1, first plane axis A1 and second plane axis A2 form with each other an angle comprised between 60° and 120°.

Preferably, this angle is comprised between 80° and 100°. In a particular application, it is 90°.

In the particular embodiments illustrated by the Figures, the most downstream oscillator, here the second oscillator 120, has, at a particular point, a means of interaction, such as a pin, forming guide means 42 for cooperating with escape wheel 51. The oscillations of the two resonators, first oscillator 110 and second oscillator 120, are maintained by escape wheel 51, which also has a means of interaction, such as a cam or a groove, and particularly a radial groove, forming complementary guide means 52. Escape wheel 51 is subjected to a drive torque. Its speed is synchronized by the frequency of the two resonators.

The movement of each oscillator of regulating mechanism 100 is preferably planar. The planes of mobility of the various oscillators forming regulating mechanism 100 may coincide, or be parallel to each other.

Thus, preferably, regulating mechanism 100 comprises first planar guide means, which are arranged to allow at least a pivoting motion of first structure 310 with respect to a point on plate 1, in a plane P parallel to that of plate 1. Likewise, regulating mechanism 100 comprises second planar guide means, which are arranged to allow an at least pivoting motion of second structure 320 with respect to first structure 310 in plane P or in a plane parallel to said plane P.

In a particular embodiment, second rigid structure 320 is mounted to pivot on first rigid structure 310.

FIG. 1 illustrates a first variant, wherein two conventionally pivoted sprung balances, placed one atop the other, are synchronized with a gear train via a pin-groove interaction. There is thus created a mechanical watch 300 provided with two balances, one atop the other and synchronized by a grooved wheel.

More specifically, first oscillator 110 comprises a first sprung balance assembly 11. This first sprung balance 11 comprises a first balance 31, forming first rigid structure 310, and a first balance spring 21, which forms the first elastic return means 210, and the outer coil of which is attached to plate 1 at a first balance spring stud 61, and which pivots about a first pivot axis O1.

First balance 31 comprises a first pivot 41, which is off-centre with respect to first pivot axis O1. This first pivot 41 defines a second pivot axis O2 about which pivots a second sprung balance assembly 12, which forms second oscillator 120.

This second sprung balance assembly 12 comprises a second balance 32, which forms second rigid structure 320, and a second balance spring 22, which forms the second elastic return means 220, and whose outer coil is attached to first balance 31 at a second balance spring stud 62. This second balance 32 forms second structure 320 comprising guide means 42.

Figure 2:
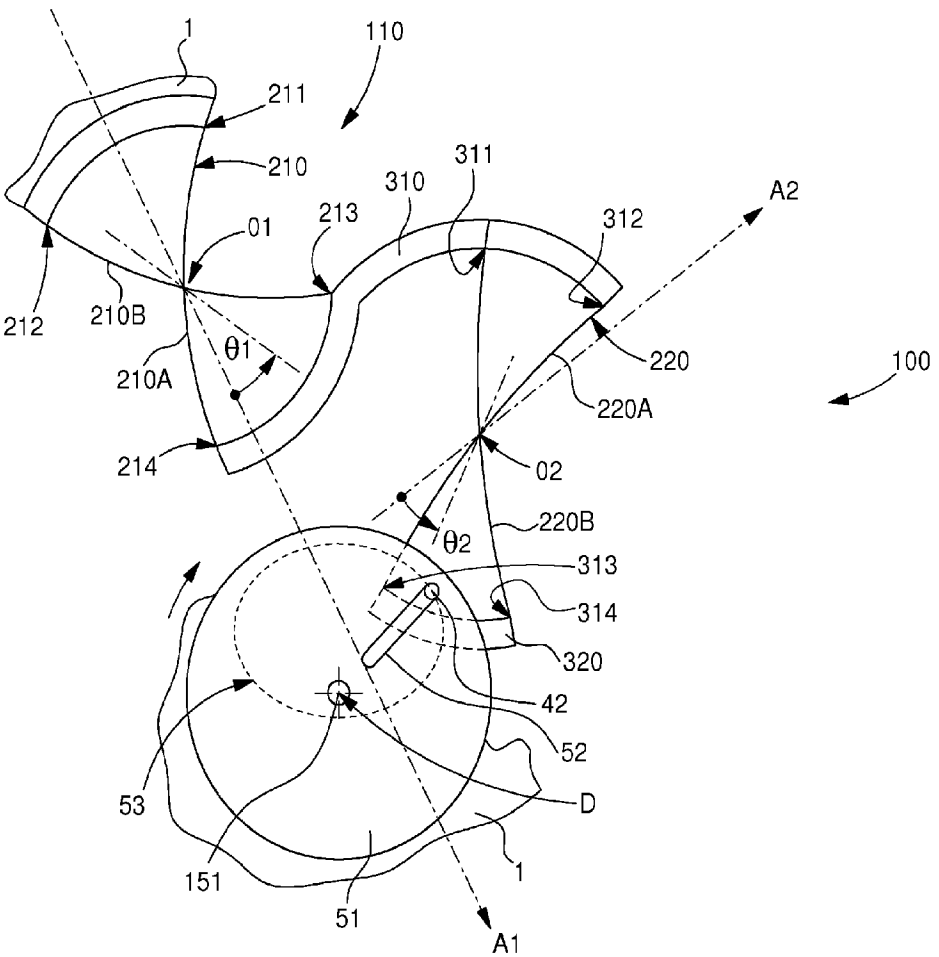
FIG. 2 shows a schematic plan view of a second variant of a regulating mechanism according to the invention, comprising two sectoral balances connected by sets of crossed strips, the first to a plate, and the second, which cooperates with an escape wheel, connected to the first balance, in an instantaneous state during an oscillation of each of its oscillators.
Figure 3:
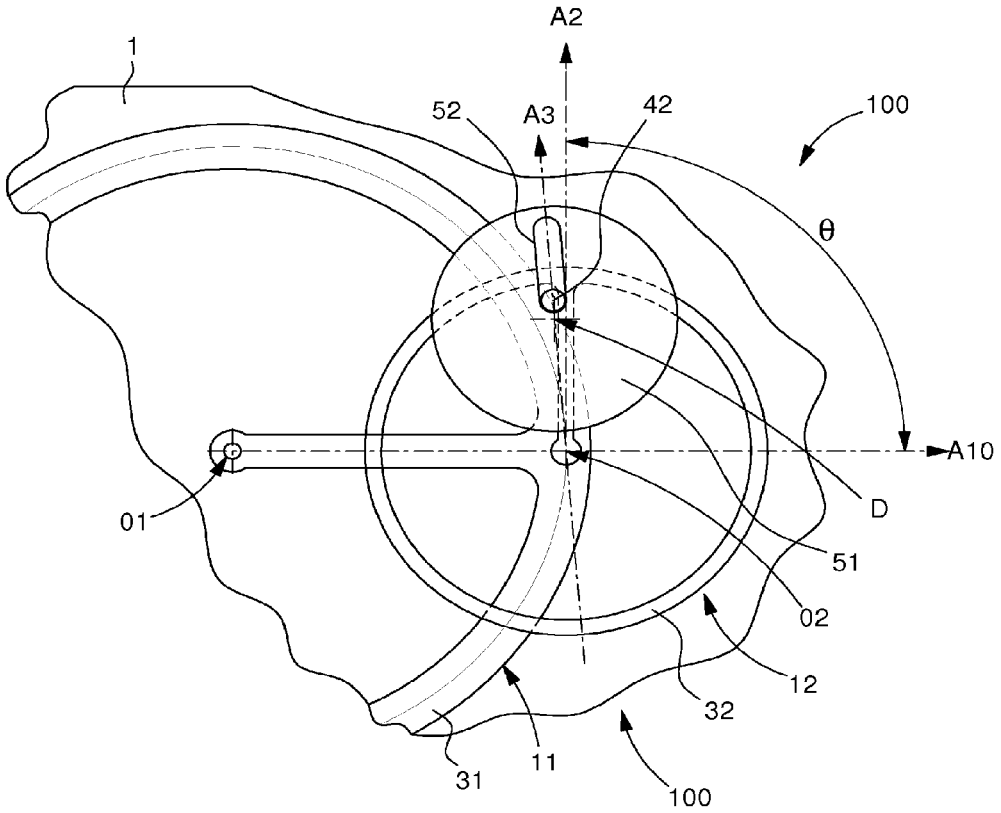
FIG. 3 represents the mechanism of FIG. 1 in a rest state in the absence of any excitation; the balance springs are not represented.
Figure 4:
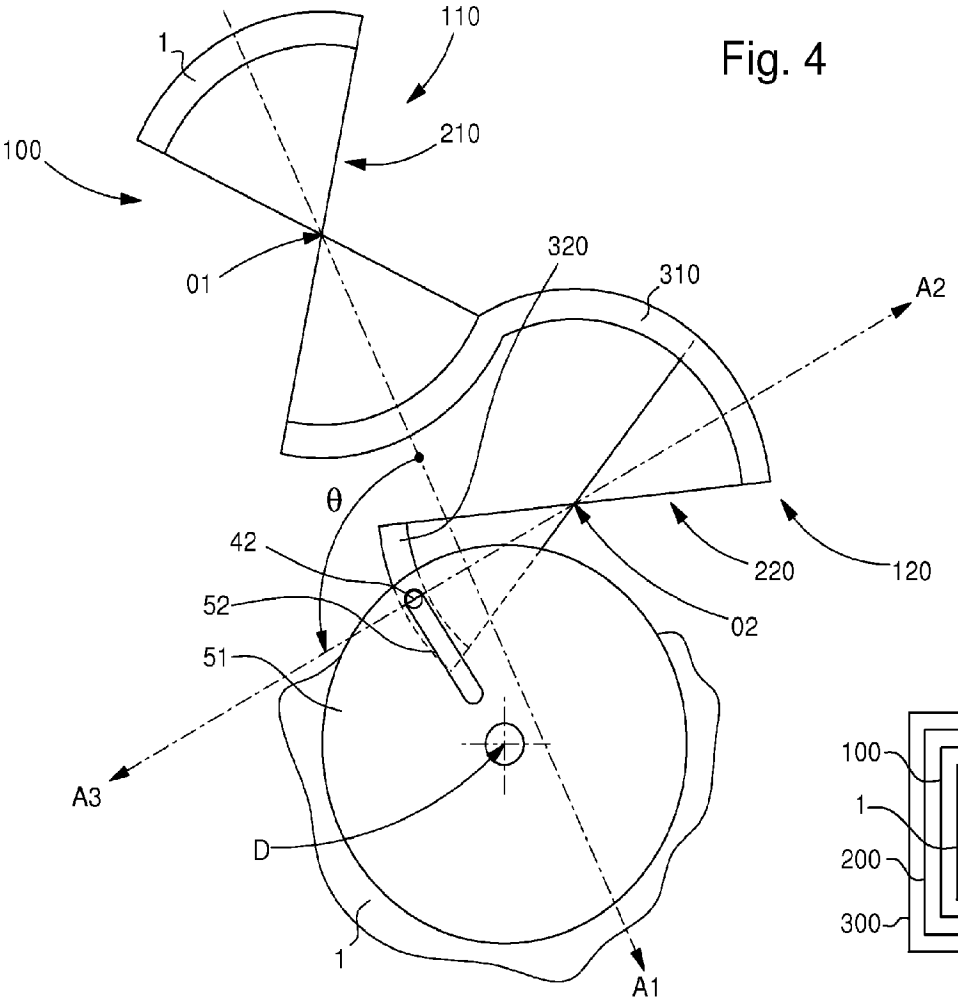
FIG. 4 represents the mechanism of FIG. 2, in a rest state in the absence of any excitation.
Figure 5:
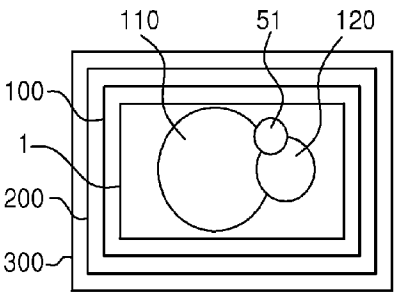
FIG. 5 is a block diagram illustrating a timepiece comprising a watch fitted with a movement with a regulating mechanism according to the invention.

FIG. 2 illustrates a second variant, wherein two balances with crossed strips, in cascade with each other, are synchronized with a gear train via a pin-groove interaction.

A first balance, formed here in a non-limiting manner of two circular sectors, end-to-end, forms first rigid structure 310. A second balance, formed here in a non-limiting manner of a circular sector, forms second rigid structure 320. More particularly, first balance 310 and second balance 320 are coplanar.

More specifically, in this second variant, the first elastic return means 210 comprise at least a first flexible strip 210A and a second flexible strip 210B, which are crossed with each other, and which together form the first planar guide means arranged to allow at least a pivoting motion of the first structure 310 with respect to a part 101 of plate 1 in a plane P parallel to that of plate 1. This part 101 of plate 1 may be an added element, or form part of plate 1. First flexible strip 210A is attached to part 101 of plate 1 at a point 211, and to first balance 310 at a point 214, and second flexible strip 210B is attached to part 101 of plate 1 at a point 212, and to first balance 310 at a point 213.

In a preferred embodiment, first flexible strip 210A and second flexible strip 210B are remote from each other and arranged in two distinct planes parallel to plate 1.

Second elastic return means 220 comprise, in a similar manner, at least a third flexible strip 220A and a fourth flexible strip 220B crossed with each other and together forming the second planar guide means arranged to allow at least a pivoting motion of second structure 320 with respect to first structure 310 in a plane P parallel to that of plate 1, and to ensure an elastic return function. Third flexible strip 220A is attached to first balance 310 at a point 312, and to second balance 320 at a point 313, and fourth flexible strip 220B is attached to first balance 310 at a point 311, and to second balance 320 at a point 314.

In a preferred embodiment, third flexible strip 220A and fourth flexible strip 220B are remote from each other and arranged in two distinct planes parallel to plate 1.

These various crossed strips are advantageously made in two parallel planes.

In an advantageous embodiment, part 101 of plate 1, first flexible strip 210A and second flexible strip 210B, first balance 310, third flexible strip 220A and fourth flexible strip 220B, second balance 320, form a one-piece assembly made of micromachinable material, such as silicon or suchlike.

In a particular embodiment, the whole of plate 1, first flexible strip 210A and second flexible strip 210B, first balance 310, third flexible strip 220A and fourth flexible strip 220B, second balance 320, form a one-piece assembly made of micromachinable material, such as silicon or suchlike.

For both of the first and second embodiments, which are not limiting of the invention, guide means 42 and complementary guide means 52 may take different forms.

In the variants illustrated by the Figures, the cooperation between guide means 42 and complementary guide means 52 is mechanical.

In the embodiments illustrated in FIGS. 1 and 2, guide means 42 comprise a finger, which is carried by second rigid structure 320, and which is arranged to cooperate with two opposite surfaces of a cam forming complementary guide means 52, and comprised in escape wheel 51. This cam is off-centre with respect to axis of escapement D, and the trajectory 53 of the finger encircles axis of escapement D.

Preferably, this cam is a groove having parallel sides comprised in escape wheel 51.

In an advantageous embodiment of the second variant, part 101 of plate 1, first flexible strip 210A and second flexible strip 210B, first balance 310, third flexible strip 220A and fourth flexible strip 220B, second balance 320 and finger 42 (or suchlike), form a one-piece assembly made of micromachinable material, such as silicon or suchlike.

In particular, the cam is a substantially radial groove, or strictly radial in the case of the Figures, of escape wheel 51.

Advantageously, the cam-groove comprises a first inner radial portion with respect to axis of escapement D, which is tangent to a second curved portion whose concavity is constant or decreases as it moves away from axis of escapement D so as to compensate for isochronism defects.

In a particular embodiment, the finger is a pin which is arranged to cooperate with minimum play with the groove, the motion transmission means is thus a pin-groove system.

In a particular embodiment, guide means 42 comprise a finger carrying an inner cage of a ball bearing. The outer cage of the bearing is advantageously mounted in a slide-contact rubbing with friction inside a radial groove of the escape wheel. This slide-contact promotes a 90° phase shift between the two resonators and thus prevents the trajectory collapsing into a line.

In a particular embodiment, first oscillator 110 pivots about a first pivot axis O1 and oscillates in a plane parallel to plate 1 on either side of a first plane axis A1, second oscillator 120 pivots about a second pivot axis O2 and oscillates in a plane parallel to plate 1 about a second plane axis A2, and, in a rest position of first oscillator 110 and of second oscillator 120 free of any excitation, first pivot axis O1, second pivot axis O2, and the finger together define an angle e comprised between 60° and 120°. Preferably, this angle e is comprised between 80° and 100°.

In a particular embodiment of the invention, the cooperation between guide means 42 and complementary guide means 52 is magnetic and/or electrostatic.

Thus, more particularly, in another embodiment that is not illustrated by the Figures, to remove friction, guide means 42 include at least one magnet or one ferromagnetic path, arranged to cooperate with at least one magnet or one ferromagnetic path comprised in complementary guide means 52.

In another embodiment, not illustrated by the Figures, also for removing friction, guide means 42 include at least one electrically charged or electrostatically conductive path, arranged to cooperate with at least one electrically charged or electrostatically conductive path comprised in complementary guide means 52.

The invention also concerns a timepiece movement 200 including such a regulating mechanism 100.

The invention also concerns a timepiece 300 including such a movement 200, and notably said timepiece 300 is a watch.

The invention has numerous advantages:

the invention avoids the jerky movements characteristic of a Swiss lever escapement and consequently losses due to shocks;

the invention proposes an innovation in the field of the escapement while respecting conventional watchmaking codes by maintaining sprung balances;

in the first variant, advantage can be taken of all the watchmaker's knowledge for using isochronous resonators.

The invention claimed is:

1. A timepiece regulating mechanism comprising:

a plate and, mounted to move at least in a pivoting motion with respect to the plate, an escape wheel, which pivots about an axis of escapement and is configured to receive a drive torque via a gear train;

a first oscillator comprising a first rigid structure connected to the plate by first elastic return means;

at least a second oscillator comprising a second rigid structure connected to the first rigid structure by second elastic return means configured to allow at least a pivoting motion of the second rigid structure with respect to the first rigid structure;

wherein the second structure comprises guide means configured to cooperate with complementary guide means comprised in the escape wheel, together forming a motion transmission means for synchronizing the first oscillator and the second oscillator with the gear train, wherein the second rigid structure is mounted to pivot on a periphery of the first rigid structure.

2. The regulating mechanism according to claim 1, wherein the first oscillator and the second resonator have equal natural frequencies.

3. The regulating mechanism according to claim 2, wherein the first oscillator and the second resonator have between them a substantially constant phase shift of substantially 90°.

4. The regulating mechanism according to claim 1, wherein the regulating mechanism comprises the first oscillator and the second oscillator each including a sprung balance assembly, wherein the second oscillator pivots on the first oscillator and cooperates with the escape wheel, in an instantaneous state during an oscillation of each of the sprung balance assemblies, the escape wheel maintains the first oscillator in a first direction, and maintains the second oscillator in a second direction substantially orthogonal to a first direction of oscillation of the first oscillator.

5. The regulating mechanism according to claim 4, wherein the first oscillator comprises a first sprung balance assembly comprising a first balance and a first balance spring, whose outer coil is attached to the plate at a first balance spring stud, and which pivots about a first pivot axis, wherein the first balance comprises a first pivot, off-center with respect to the first pivot axis, defining a second pivot axis about which pivots a second sprung balance assembly, which forms the second oscillator and which comprises a second balance and a second balance spring, whose outer coil is attached to the first balance at a second balance spring stud, and wherein the second balance forms the second structure comprising the guide means.

6. The regulating mechanism according to claim 1, wherein the first oscillator pivots about a first pivot axis and oscillates in a plane parallel to the plate on either side of a first plane axis, wherein the second oscillator pivots about a second pivot axis and oscillates in a plane parallel to the plate on either side of a second plane axis, wherein, in projection onto the plate, the first plane axis and the second plane axis form with each other an angle between 60° and 120°.

7. The regulating mechanism according to claim 6, wherein, in projection onto the plate, the first plane axis and the second plane axis form with each other an angle between 80° and 100°.

8. The regulating mechanism according to claim 1, wherein the regulating mechanism comprises first planar guide means, configured to allow at least a pivoting motion of the first structure with respect to a point on the plate, in a plane parallel to that of the plate, wherein the regulating mechanism comprises second planar guide means configured to allow at least a pivoting motion of the second structure with respect to the first structure in the plane or in a plane parallel to the plane.

9. The regulating mechanism according to claim 8, wherein the first elastic return means comprises at least a first flexible strip and a second flexible strip crossed with each other and together forming the first planar guide means configured to allow at least a pivoting motion of the first structure with respect to a point on the plate in a plane parallel to that of the plate, for an elastic return function.

10. The regulating mechanism according to claim 9, wherein the first flexible strip and the second flexible strip are remote from each other and configured in two distinct planes parallel to the plate.

11. The regulating mechanism according to claim 9, wherein the plate, the first flexible strip and the second flexible strip, the first balance, the third flexible strip and the fourth flexible strip, and the second balance, form a one-piece assembly made of micromachinable material or of silicon.

12. The regulating mechanism according to claim 8, wherein the second elastic return means comprises at least a third flexible strip and a fourth flexible strip crossed with each other and together forming the second planar guide means configured to allow at least a pivoting motion of the second structure with respect to the first structure in the plane.

13. The regulating mechanism according to claim 12, wherein the third flexible strip and the fourth flexible strip are remote from each other and configured in two distinct planes parallel to the plate.

14. The regulating mechanism according to claim 1, wherein cooperation between the guide means and the complementary guide means is mechanical.

15. The regulating mechanism according to claim 14, wherein the guide means comprises a finger carried by the second rigid structure and configured to cooperate with two opposite surfaces of a cam forming the complimentary guide means comprised in the escape wheel, the cam being off center with respect to the axis of escapement, and trajectory of the finger encircling the axis of escapement.

16. The regulating mechanism according to claim 15, wherein the cam is a groove having parallel sides comprised in the escape wheel.

17. The regulating mechanism according to claim 16, wherein the groove is substantially radial with respect to the axis of escapement.

18. The regulating mechanism according to claim 16, wherein the groove comprises a first inner radial portion with respect to the axis of escapement, which is tangent to a second curved portion whose concavity is constant or decreases moving away from the axis of escapement to compensate for isochronism defects.

19. The regulating mechanism according to claim 16, wherein the finger is a pin which is configured to cooperate with minimum play with the groove, the motion transmission means thus being a pin-groove system.

20. The regulating mechanism according to claim 14, wherein the guide means comprises a finger carrying an inner cage of a ball bearing whose outer cage is mounted in a slide-contact rubbing with friction inside a radial groove of the escape wheel, which forms the complementary guide means, to remove any rotational friction of the inner cage and ensure friction during radial movement of the outer cage.

21. The regulating mechanism according to claim 15, wherein the first oscillator pivots about a first pivot axis and oscillates in a plane parallel to the plate on either side of a first plane axis, wherein the second oscillator pivots about a second pivot axis and oscillates in a plane parallel to the plate about a second plane axis, and wherein, in a rest position of the first oscillator and of the second oscillator free of any excitation, the first pivot axis, the second pivot axis, and the finger together define an angle between 60° and 120°.

22. The regulating mechanism according to claim 21, wherein the angle is between 80° and 100°.

23. The regulating mechanism according to claim 1, wherein cooperation between the guide means and the complementary guide means is magnetic and/or electrostatic.

24. The regulating mechanism according to claim 23, wherein the guide means comprises at least one magnet or one ferromagnetic path, configured to cooperate with at least one magnet or one ferromagnetic path comprised in the complementary guide means.

25. The regulating mechanism according to claim 23, wherein the guide means includes at least one electrically charged or electrostatically conductive path, configured to cooperate with at least one electrically charged or electrostatically conductive path comprised in the complementary guide means.

26. A timepiece movement comprising the regulating mechanism according to claim 1.

27. A timepiece comprising the movement according to claim 26, wherein the timepiece is a watch.

* * * * *